US005685127A

United States Patent [19]

Finkowski

[11] Patent Number: 5,685,127

[45] Date of Patent: Nov. 11, 1997

[54] UNIVERSAL SPOON FOR LOADING DOUGH INTO CONTAINERS

[75] Inventor: James W. Finkowski, Andover, Minn.

[73] Assignee: The Pillsbury Company, Minneapolis, Minn.

[21] Appl. No.: 503,380

[22] Filed: Jul. 17, 1995

[51] Int. Cl.[6] ..... B65B 1/04

[52] U.S. Cl. ..... 53/255; 53/235; 53/244; 53/249

[58] Field of Search ..... 53/235, 255, 259, 53/260, 244, 249, 258, 566, 251, 252, 467, 473

[56] References Cited

U.S. PATENT DOCUMENTS

| | | | |
|---|---|---|---|
| 2,540,489 | 2/1951 | Pretzer | 53/259 |
| 3,451,192 | 6/1969 | Irwin | 53/190 |
| 3,458,970 | 8/1969 | Reid et al. | 53/159 |
| 4,052,838 | 10/1977 | Hilton et al. | 53/255 |
| 5,048,266 | 9/1991 | Wieckowicz | 53/390 |
| 5,305,808 | 4/1994 | Rasmussen et al. | 141/169 |

FOREIGN PATENT DOCUMENTS

| | | | |
|---|---|---|---|
| 1215066 | 11/1959 | France | 53/255 |
| 1461449 | 12/1966 | France . | |
| 1047106 | 2/1953 | Germany . | |
| 5139411 | 6/1993 | Japan | 53/255 |
| 9321068 | 10/1993 | WIPO | 53/260 |

*Primary Examiner*—Daniel Moon
*Assistant Examiner*—Ed Tolan
*Attorney, Agent, or Firm*—Westman, Champlin & Kelly, P.A.

[57] ABSTRACT

A preferred form of a packing apparatus of the present invention for loading a dough product into a container opening includes a frame and a loading member joined to the frame. The loading has a first opening for receiving the dough product to be packed, and a second opening through which the dough product exists off the loading member and into the container. An inner surface joins the first opening to the second opening. The inner surface has an extending tang disposed at the second opening. The extending tang is insertable within the container opening. A support member supports the container proximate the second opening for insertion of the dough product into the container.

15 Claims, 7 Drawing Sheets

UNIVERSAL SPOON FOR LOADING DOUGH INTO CONTAINERS

BACKGROUND OF THE INVENTION

The present invention relates generally to packing devices used to insert dough into containers. In particular, the present invention is a universal spoon capable of inserting dough into containers of various sizes.

Apparatuses for inserting dough into containers are generally known. U.S. Pat. No. 3,458,970 to Reid et al. discloses one such dough packing apparatus. The dough packing apparatus of Reid et al. includes a mechanism for rolling and slitting a dough sheet to form a plurality of longitudinally aligned adjacent rolls of dough, and a receiving mechanism for grouping the dough pieces, for example, in pairs and for providing a predetermined spacing between single pieces. In a preferred form of the apparatus, the receiving mechanism includes a pair of vertically spaced endless conveyors with receiving cups on one side of the side edges of the lower conveyor for initially holding the pieces. An upper conveyor is obliquely mounted and is adapted to contact the upper surfaces of the pieces located in the cups when they have reached a predetermined position and thereafter roll them to the lower conveyor to the opposite edge thereof. From the edge of the lower conveyor, the products fall to an indexing drum which in turn retains them for a predetermined period of time and then transfers them to one of several supporting and guiding spoons mounted on an endless loading conveyor. A container dispenser provides containers to the loading conveyor which includes a provision for supporting the containers in position to receive the rolls from spoons.

In a preferred form of the Reid et al. apparatus, the spoons are troughs mounted for pivotal movement whereby the spoons can be tilted to transfer the rolls by gravity from the spoons into the containers. Each spoon has a tapered exit opening that has a lower portion or edge that is inserted in a container opening of each container and adjacent to an inner surface. The dough roll slides along a lower surface of the spoon and exits the exit opening to be deposited in the container. The spoons are commonly formed by cutting a long rectangular sheet of metal to form a V-shaped end. The sheet of metal is then stamped to form the elongated spoon, the V-shaped end of the sheet of metal thereby forming the tapered exit opening.

As stated above, it is preferable to position a lower portion of the exit opening within the container adjacent an inner surface of the container so that the dough roll (which has a diameter similar to the container opening) slides easily into the container. However, it is also desirable to use a packing apparatus such as that disclosed by Reid et al. for a number of different sized containers. This entails that the spoons be replaced since the exit openings are designed only to work with a certain size container opening. For instance, a relatively large spoon that works with a large container will not work with a smaller container because sufficient overlap between a lower portion of the exit opening and the inner surface of the container cannot be obtained without moving the lower surface of the exit opening farther away from the inner surface of the container. However, even if a sufficient overlap is obtained, the dough roll cannot be inserted into the container because the dough roll will not pass through the remaining space between the lower surface of the exit opening and the remaining open area of the container opening.

Therefore, the present dough packing apparatus is dedicated to pack only one size dough product into corresponding sized containers wherein each product requires a particular spoon to deposit the dough product into the containers.

SUMMARY OF THE INVENTION

There is a need to provide a capability to pack a range of differently sized products using one processing line. In particular, there is a need for a universal spoon which can efficiently accommodate different sized dough products by transferring the products into corresponding dough product containers, without dedicating an entire processing line to one sized product or completely retooling one line to accommodate a different sized dough product.

A preferred form of a packing apparatus of the present invention for loading a dough product into a container opening includes a frame and a loading member joined to the frame. The loading member has a first opening for receiving the dough product to be packed, and a second opening through which the dough product exits off the loading member and into the container. An inner surface joins the first opening to the second opening. The inner surface has an extending tang disposed at the second opening. The extending tang is insertable within the container opening. A support member supports the container proximate the second opening for insertion of the dough product into the container.

DETAILED DESCRIPTION OF THE PREFERRED EMBODIMENTS

Figure 1:
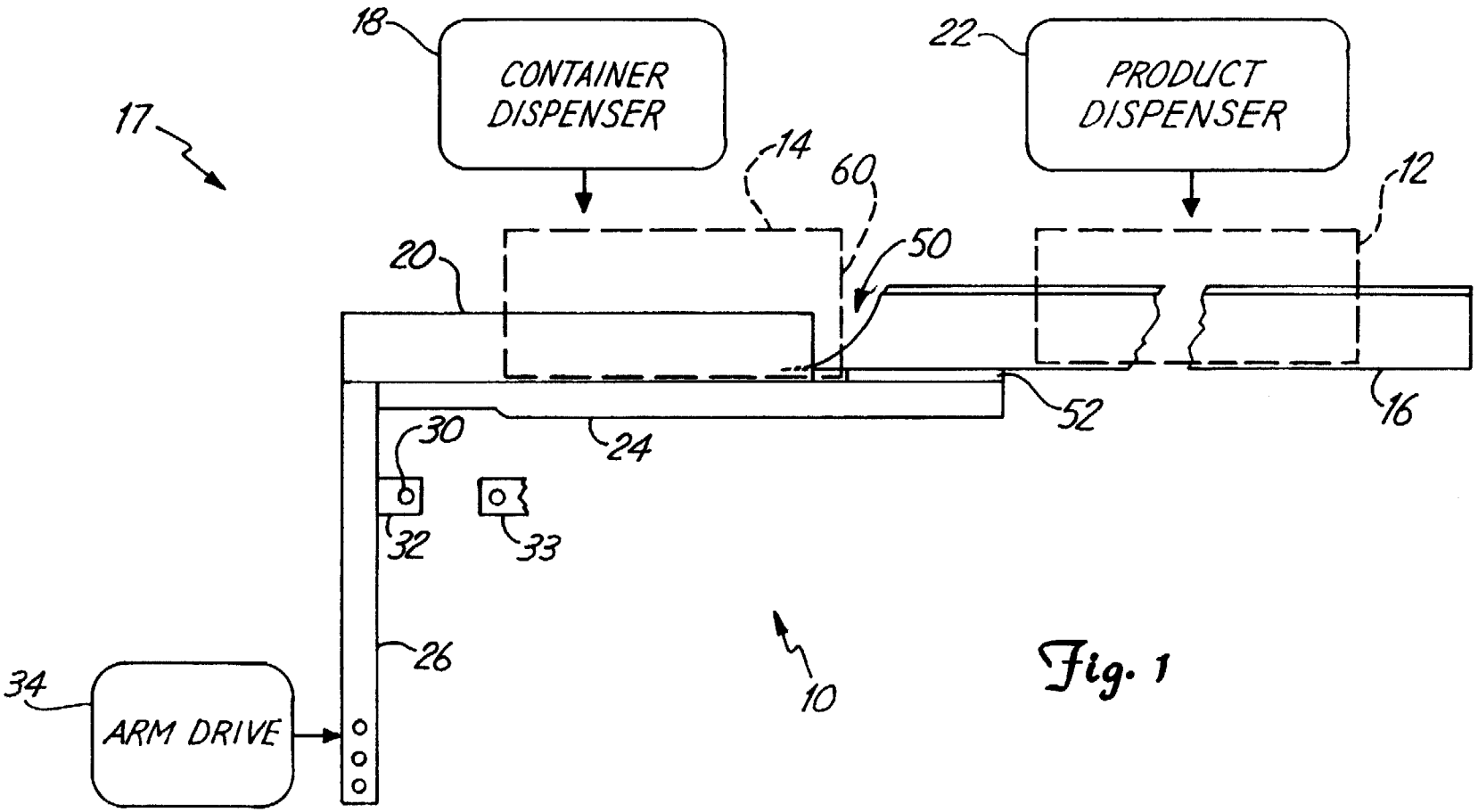
FIG. 1 is a side elevational view of a packing arm including a spoon of the present invention with portions removed.

FIG. 1 illustrates a packing arm 10 for inserting a product such as a dough roll 12 into a suitable container 14. The packing arm 10 includes a guide trough or spoon 16 of the present invention that allows the packing arm 10 to be used with products and containers having different sizes.

Typically, a plurality of packing arms such as indicated at 10 would be mounted to a conveyor line as part of a complete production line for continuously packaging dough rolls within associated containers. U.S. Pat. No. 3,458,970 discloses a production line apparatus in detail, which is hereby incorporated by reference and schematically illustrated in FIG. 1 at 17.

Briefly, the production line apparatus 17 includes a container dispenser 18 for periodically placing containers 14 on a container support member 20 and a product dispenser 22 that periodically places dough rolls 12 on the spoon 16. Both the container support member 20 and the spoon 16 are mounted on a support carriage 24 that includes a drive arm 26. The support carriage 24 pivots about a pivot axis extending through an aperture 30 of a flange 32 joined to the drive arm 26. The flange 32 is pivotally joined to a suitable frame member 33, which as described in U.S. Pat. No. 3,458,970 is part of a conveyor.

Figure 2:
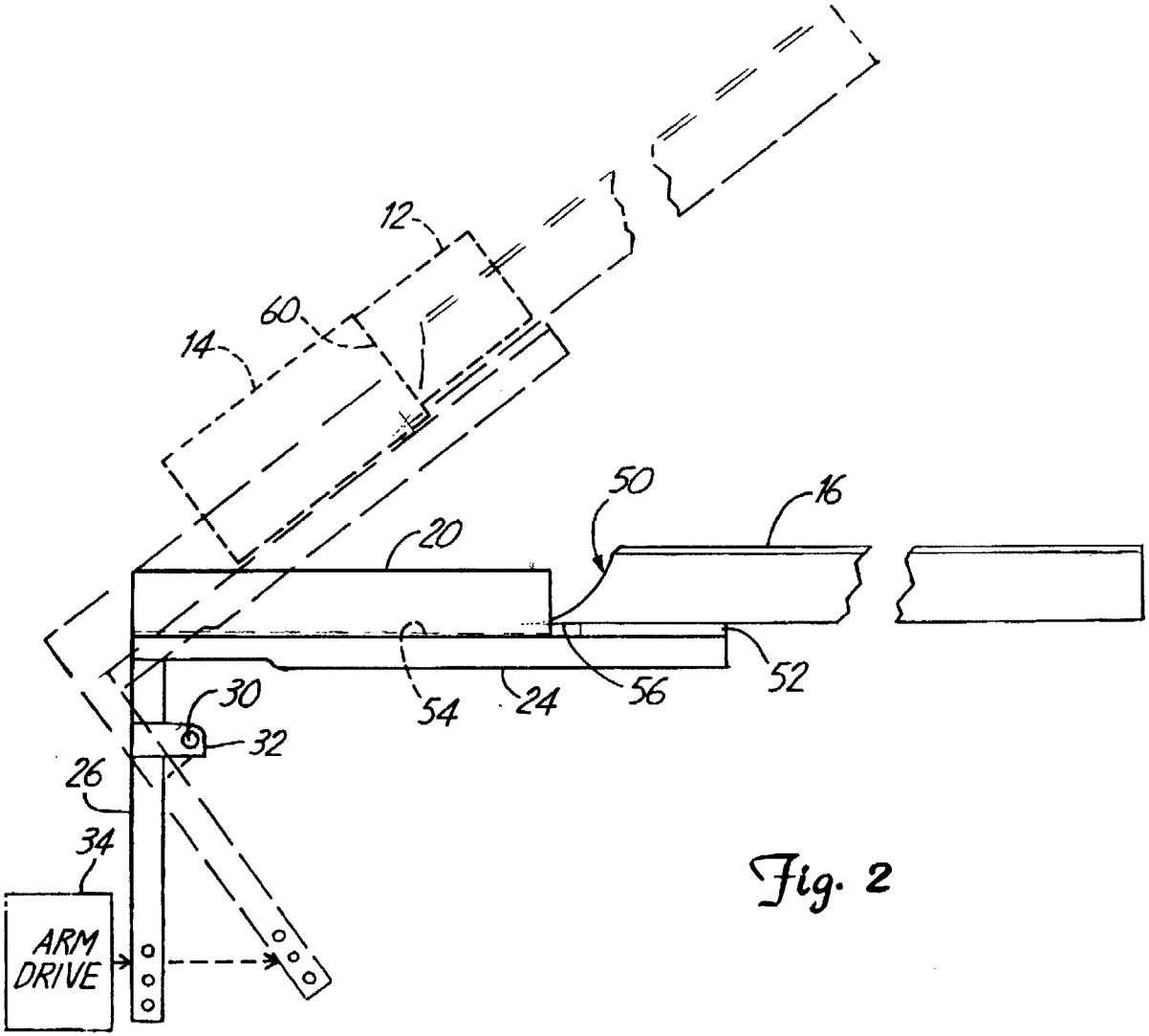
FIG. 2 is a side elevational view illustrating two positions of the packing arm.

As illustrated in FIG. 2, after the dough roll 12 and the container 14 have been placed on the packing arm 10, a suitable mechanism herein schematically illustrated as an arm drive 34, displaces the drive arm 26 to rotate the carriage 24, the container support member 20 and the spoon 16 about the pivot axis of flange 32, which in turn lifts the dough roll 12 above the container 14 so that the dough roll 12 moves under the influence of gravity into the container 14. Typically, the arm drive 34 is a stationary guide rail, not shown, that is positioned adjacent the drive arm 26 and which contacts the drive arm 26 to rotate it in the direction shown as the drive arm 26 moves past the stationary guide rail. Of course, other suitable arm drives such as hydraulic or pneumatic cylinders can be used.

Figure 3:
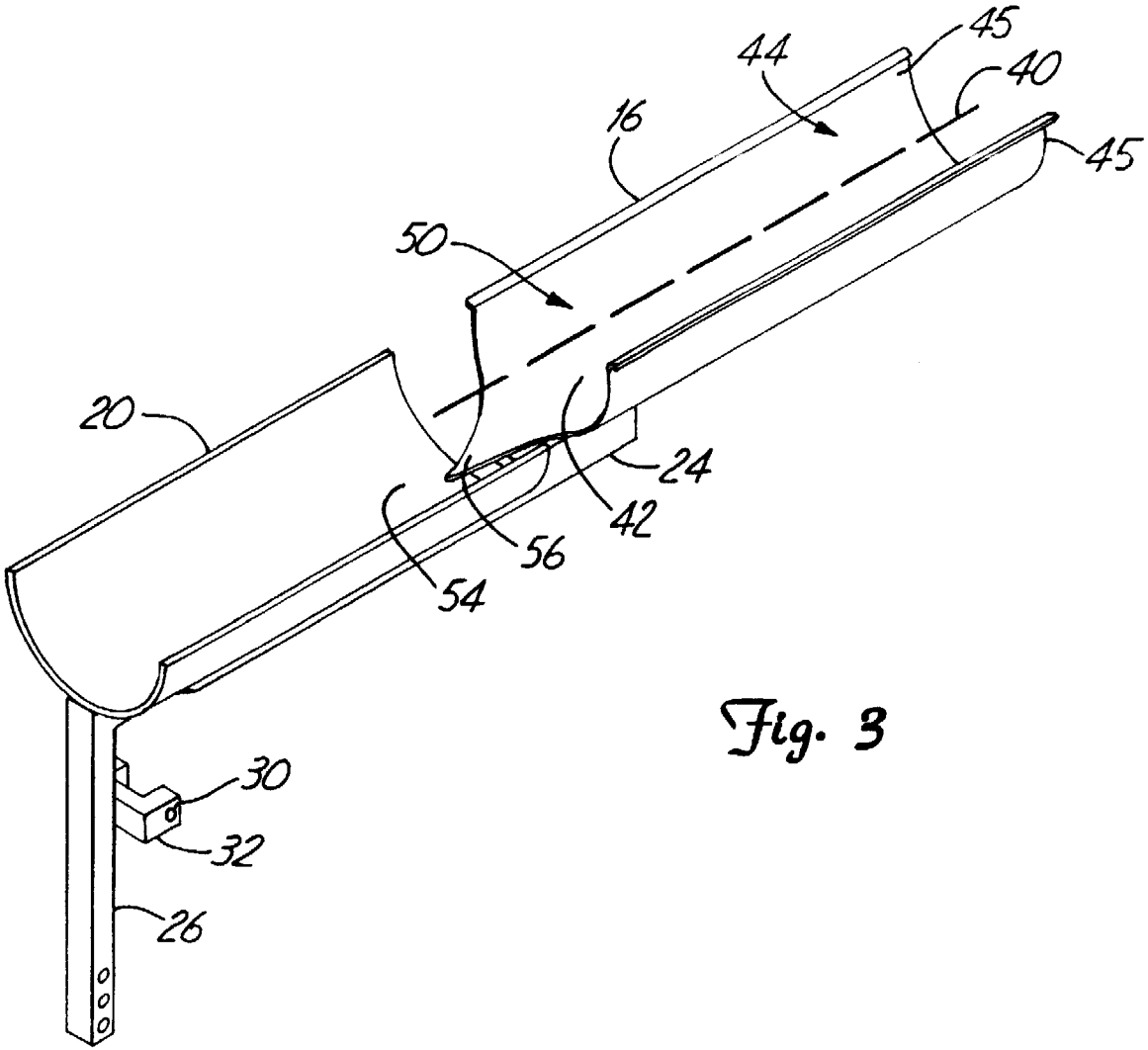
FIG. 3 is a perspective view of the packing arm and the spoon.

Referring also to FIG. 3, the spoon 16 is an elongated open trough having a longitudinal axis 40. The dough roll 12 is placed upon a lower surface 42 of the spoon 16 through an opening 44 formed between spaced-apart sidewalls 45 extending from the lower surface 42. With rotation of the packing arm 10 as illustrated in FIG. 2, the dough roll 12 slides upon the lower surface 44 and exits the spoon 16 through an exit opening indicated at 50.

Figure 4:
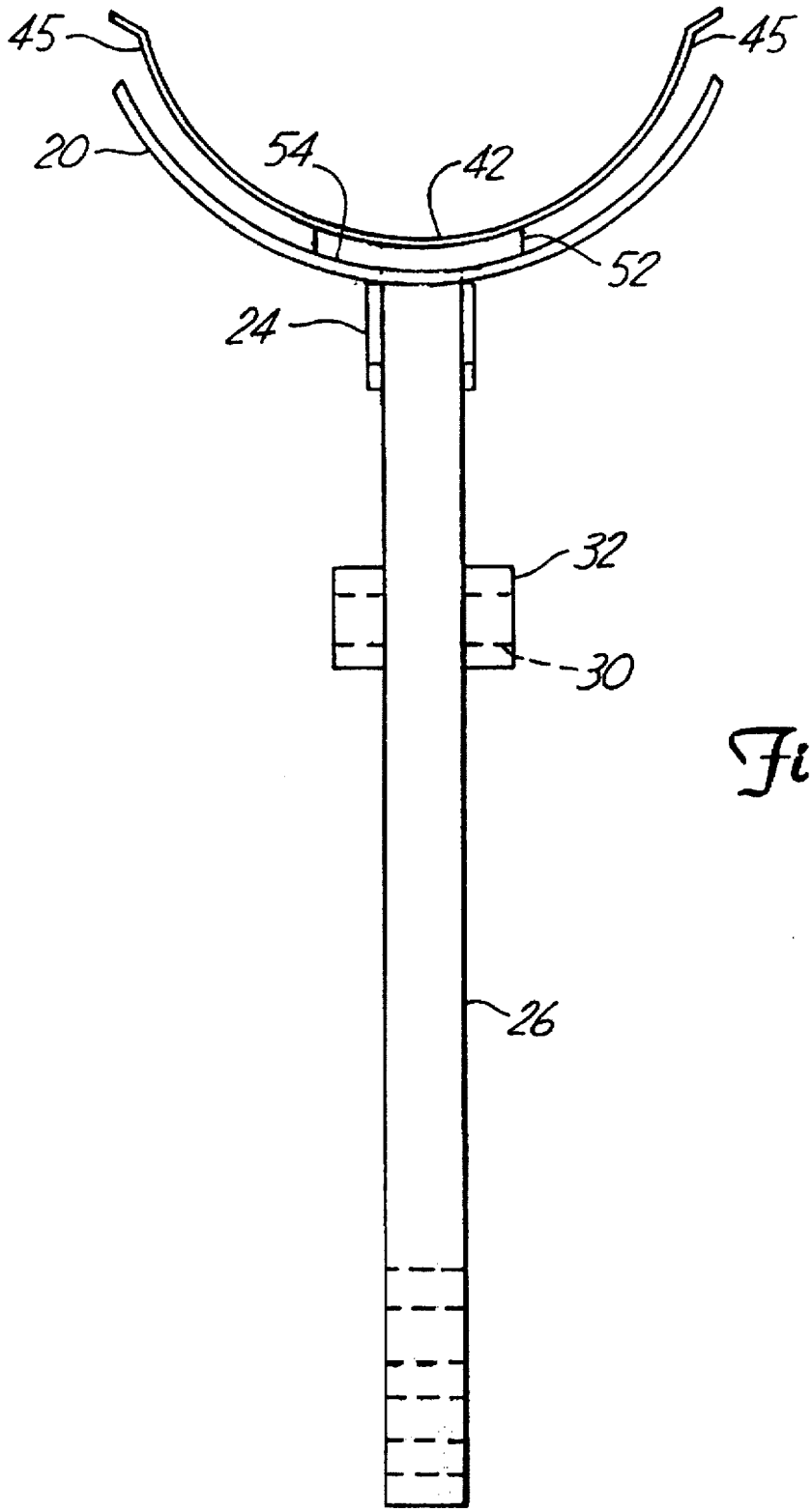
FIG. 4 is a front elevational view of the packing arm and the spoon.

Referring to FIG. 4, the spoon 16 is supported on a spacer 52 that in turn is joined to the support carriage 24. Spacer 52 elevates the lower surface 42 of the spoon 16 above a lower surface 54 of the container support member 20 such that an extending tang 56 of the lower surface 42 can be inserted within a container opening 60 of the container 14 when the container 14 has been placed upon the container support member 20. With the extending tang 56 inserted within the container 14, the dough roll 12 slides easily into the container 14 when the packing arm 10 is rotated.

Figure 6:
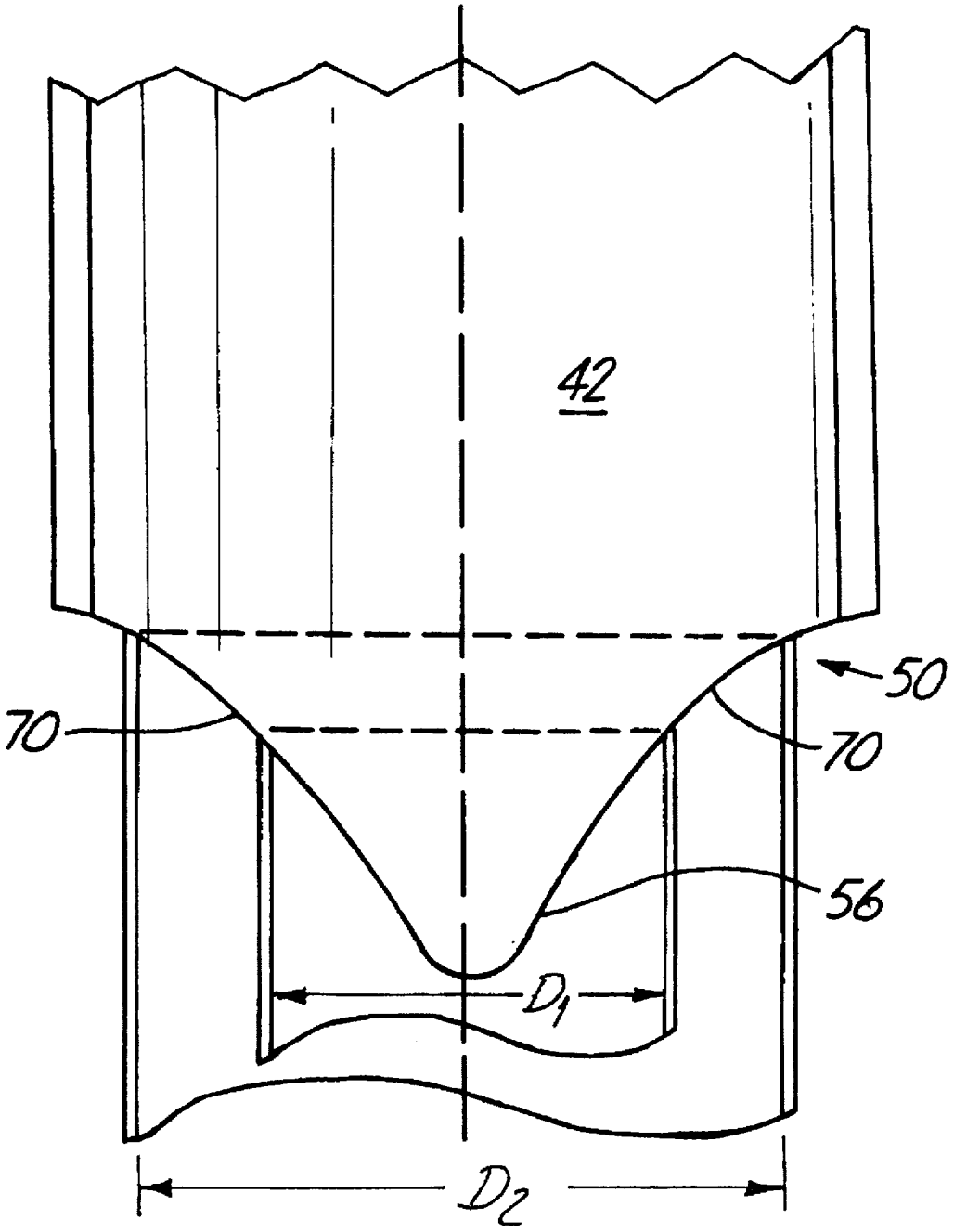
FIG. 6 is a top plan view of a portion of the spoon after being formed.

The spoon 16, and in particular, the extending tang 56 allows packing of dough products of different diameters into associated containers not otherwise available with known prior art designs. FIG. 6 illustrates two containers 62 and 64 having diameters D1 and D2, respectively. Lateral edges 70 of the exit opening 50 allow the extending tang 56 to be inserted into each of the containers 62 and 64. Specifically, the extending tang 56 extends into each of the containers 62 and 64 a sufficient distance so as to overlap a lower portion of each corresponding container opening allowing the dough products to slide easily from the lower surface 42 of the spoon 16 through the container openings without contacting the associated container openings.

Figure 5:
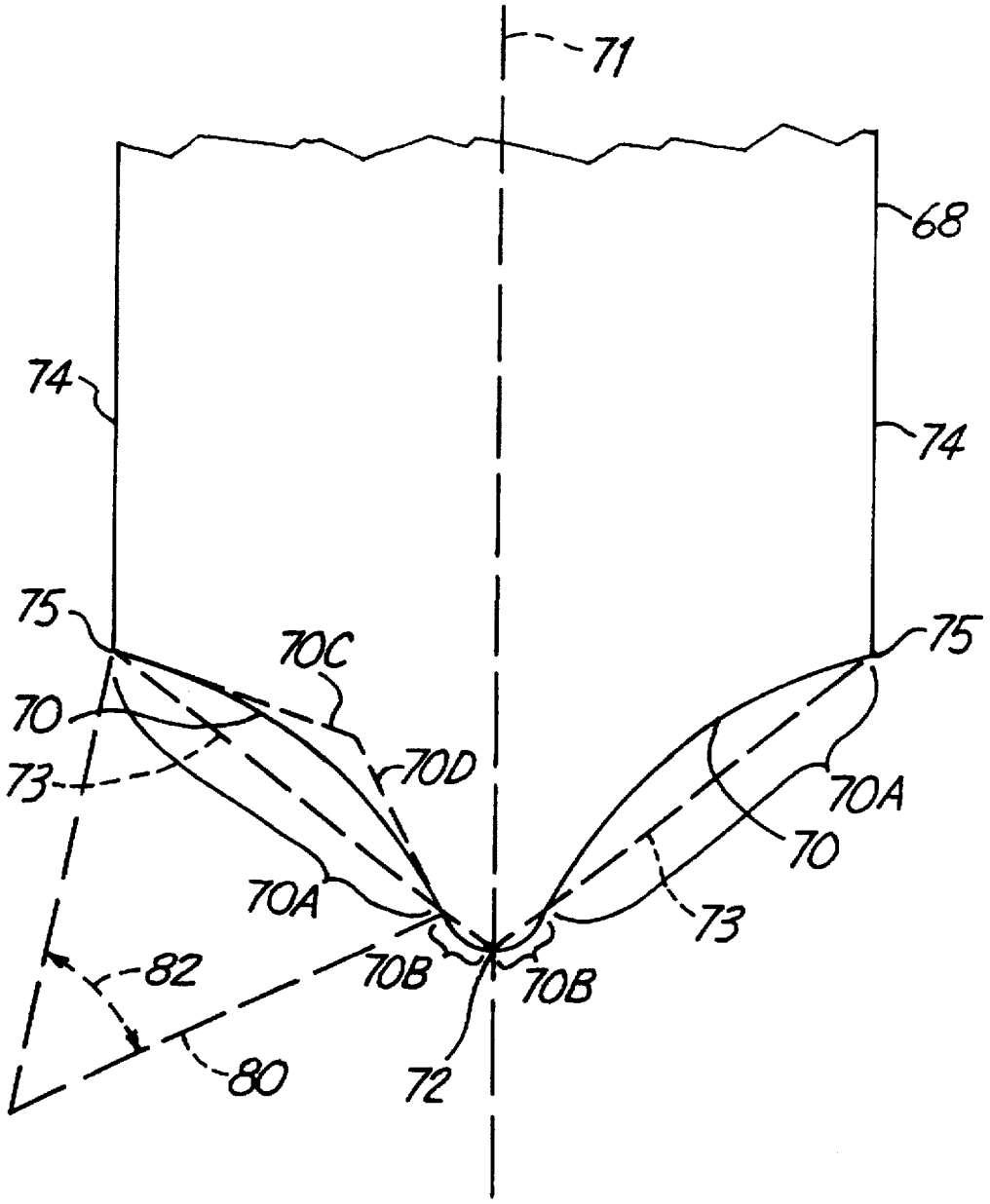
FIG. 5 is a top plan view of a portion of the spoon laid flat.

Referring to FIG. 5, a preferred method of making the spoon 16 and the extending tang 56 is by forming the spoon 16 from a sheet 68 of bendable material suitable for handling food products such as stainless steel. Generally, the extending tang 56 is formed from the pair of lateral edges 70, each starting at side edges 74 of the sheet 68 and converging at a point or tip 72, which is disposed on a center line 71 of the sheet 68. Preferably, the extending tang 56 has a width that increases for increasing distances away from the tip 72 along the center line 71.

Reference lines 73 aid in describing the lateral edges 70. The reference lines 73 are straight lines that extend from the tip 72 to an associated point 75 on each side edge 74 where the lateral edge 70 meets the corresponding side edge 74. As illustrated, the lateral edges 70 each include a concave portion 70A that extends inwardly toward the center line 71 between the tip 72 and each corresponding point 75 as opposed to a convex portion indicated at 70B that extends outwardly from the center line 71. Preferably, the concave portion 70A intersects with the reference line 73 to reduce the total area of the extending tang 56 by the portions bounded by the lateral edges 70 and each corresponding reference line 73.

In the embodiment illustrated, each concave portion 70A is formed as an arc diverging away from the center line 71. Preferably, the concave portion 70A has a fixed radius 80 through an angle indicated by double arrow 82. Although the lateral edges 70 have been illustrated in this embodiment as smooth continuous curves, it should be understood that the lateral edges can include straight line portions, for example, 70C and 70D, which for purposes of this description also define a concave portion.

Figure 7:
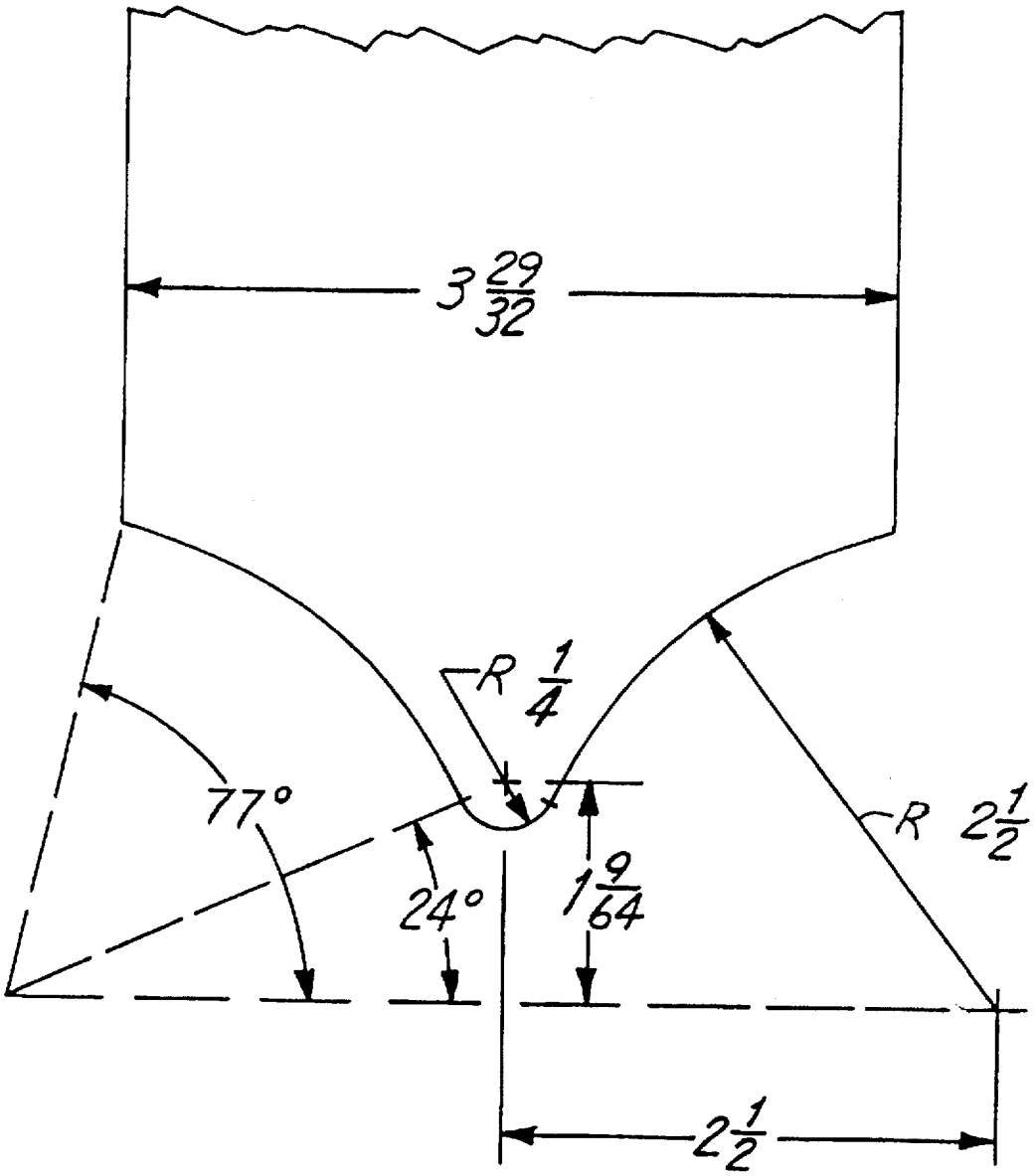
FIG. 7 is a top plan view of a preferred embodiment of a portion of spoon laid flat.

FIG. 7 illustrates machining dimensions for a portion of a flat sheet of material similar to FIG. 5 to form an approximately three inch diameter spoon of the shape illustrated in FIG. 3.

Although the present invention has been described with reference to preferred embodiments, workers skilled in the art will recognize that changes may be made in form and detail without departing from the spirit and scope of the invention.

What is claimed is:

1. An apparatus for loading a dough product into a container through a container opening, the apparatus comprising:

a frame;

a loading member joined to the frame, the loading member having a first opening for receiving the dough product, a second opening through which the dough product exits off the loading member and an inner surface joining the first opening to the second opening upon which the dough product is displaced from the first opening to the second opening, the inner surface having an extending tang which includes a tip and lateral edges defining the second opening, the lateral edges extending between the tip and the side edges of the loading member when the loading member is laid flat, the extending tang being insertable within the container opening such that the lateral edges contact the container proximate the container opening to limit displacement of the extending tang into the container; and a support member for supporting the container proximate the second opening.

2. The apparatus of claim 1 wherein the extending tang includes the tip and wherein a width of the extending tang increases with an increasing distance from the tip.

3. The apparatus of claim 2 wherein each lateral edge comprises an arc.

4. The apparatus of claim 3 wherein each lateral edge comprises an arc having a fixed radius.

5. The apparatus of claim 2 and further comprising a support frame pivotable upon the frame, the loading member and the support member joined to the support frame.

6. An apparatus for loading a dough product into a container through a container opening, the apparatus comprising:

a frame;

a loading member joined to the frame, the loading member having a first opening for receiving the dough product, a second opening through which the dough product exits off the loading member, and an inner surface joining the first opening to the second opening upon which the dough product is displaced from the first opening to the second opening, the inner surface having an extending tang which includes a tip and lateral edges defining the second opening, the lateral edges extending between the tip and the side edges of the loading member when the loading member is laid flat, wherein each lateral edge includes a concave portion, the extending tang being insertable within the container opening such that the concave portions contact the container proximate the container opening to limit displacement of the extending tang into the container; and a support member for supporting the container proximate the second opening.

7. The apparatus of claim 6 wherein the concave portion of each lateral edge intersects with a reference line extending between the tip and a point where the lateral edge meets the side edge of the loading member.

8. The apparatus of claim 6 wherein the extending tang includes the tip and wherein a width of the extending tang increases with an increasing distance from the tip.

9. The apparatus of claim 8 wherein each lateral edge comprises an arc.

10. The apparatus of claim 9 wherein each lateral edge comprises an arc having a fixed radius.

11. In combination with a container having a container opening, a loading apparatus for loading a dough product into the container through the container opening, the loading apparatus comprising:

a frame;

a loading member joined to the frame, the loading member having a first opening for receiving the dough product, a second opening through which the dough product exits off the loading member, and an inner surface joining the first opening to the second opening upon which the dough product is displaced from the first opening to the second opening, the inner surface having an extending tang which includes a tip and lateral edges defining the second opening, the lateral edges extending between the tip and the side edges of the loading member when the loading member is laid flat, the extending tang being insertable within the container opening such that the lateral edges contact the container proximate the container opening to limit displacement of the extending tang into the container; and a support member for supporting the container proximate the second opening.

12. The combination as recited in claim 11 wherein each lateral edge includes a concave portion, and wherein the concave portions contact the container proximate the container opening to limit displacement of the extending tang into the container.

13. The combination as recited in claim 12 wherein a width of the extending tang increases with an increasing distance from the tip.

14. The combination as recited in claim 13 wherein each lateral edge comprises an arc.

15. The combination as recited in claim 14 wherein each lateral edge comprises an arc having a fixed radius.

* * * * *